US006748913B2

(12) United States Patent
Nakayama

(10) Patent No.: US 6,748,913 B2
(45) Date of Patent: Jun. 15, 2004

(54) ROCKER ARM ARRANGEMENT FOR ENGINE

(75) Inventor: Manabu Nakayama, Shizuoka (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/132,646

(22) Filed: Apr. 25, 2002

(65) Prior Publication Data

US 2002/0174844 A1 Nov. 28, 2002

(30) Foreign Application Priority Data

Apr. 27, 2001 (JP) ..... 2001-132469

(51) Int. Cl.[7] ..... F01L 1/00

(52) U.S. Cl. ..... 123/90.21; 123/90.39; 74/53

(58) Field of Search ..... 123/90.16, 90.18, 123/90.39, 90.21, 90.15, 90.17, 90.4, 90.41, 90.42, 90.43, 90.44, 90.45, 90.46, 90.47; 74/53, 54, 55, 569

(56) References Cited

U.S. PATENT DOCUMENTS 3,786,792 A * 1/1974 Pelizzoni et al. ..... 123/321
4,438,735 A * 3/1984 Burandt ..... 123/90.16
4,516,542 A * 5/1985 Aoyoma et al. ..... 123/90.16
5,816,208 A 10/1998 Kimura
2001/0017119 A1 8/2001 Suzuki et al.

FOREIGN PATENT DOCUMENTS

JP 55069721 A * 5/1980 ..... F02B/29/00
JP 59126001 A * 7/1984 ..... F01L/1/18

OTHER PUBLICATIONS

Yamaha Parts Catalogue, Model Year 1997, Models F50TRV and T50TRV.
Yamaha Parts Catalogue, Models F50,T50, F50A '01, FT50B '01, pp. A1, B1, B3.

* cited by examiner

*Primary Examiner*—Thomas Denion
*Assistant Examiner*—Jaime Corrigan
(74) *Attorney, Agent, or Firm*—Knobbe, Martens, Olson & Bear, LLP

(57) ABSTRACT

An engine includes an engine body. A camshaft shaft is journaled for rotation within the engine body. A rocker arm shaft also is disposed within the engine body. Intake and exhaust rocker arms are pivotally mounted on the rocker arm shaft. The intake rocker arm is associated with an intake valve. The exhaust rocker arm is associated with an exhaust valve. The camshaft actuates the intake and exhaust valves through the intake and exhaust rocker arms, respectively. The rocker arms are axially moveable along an axis of the rocker arm shaft. A stopper is disposed on the rocker arm shaft to stop the axial movement of the rocker arms in one direction. A spring member is mounted on the rocker arm shaft opposite to the stopper to urge the rocker arms toward the stopper. A block member blocks the axial movement of the rocker arms toward the biasing member.

38 Claims, 7 Drawing Sheets

ROCKER ARM ARRANGEMENT FOR ENGINE

PRIORITY INFORMATION

This application is based on and claims priority to Japanese Patent Application No. 2001-132469, filed Apr. 27, 2001, the entire contents of which is hereby expressly incorporated by reference.

BACKGROUND OF THE INVENTION

1. Field of the Invention

The present invention relates generally to a rocker arm arrangement for an engine, and more particularly to an improved rocker arm arrangement for an engine in which a biasing member urges a rocker arm toward a stopper.

2. Description of Related Art

A four-cycle engine is one of the most popular engine types used in, for example, an outboard motor. The four-cycle engine typically includes intake and exhaust valves to selectively connect a combustion chamber with an air intake system and an exhaust system, respectively. Typically, one or more camshafts directly or indirectly actuate the intake and exhaust valves. An engine, for example, having a camshaft that indirectly actuates the intake and exhaust valves can employ rocker arms that operate between the camshaft and the intake and exhaust valves. The rocker arms are mounted on a rocker arm shaft that extends generally parallel to the camshaft.

The rocker arms pivot about the rocker arm shaft to operate the intake and exhaust valves when actuated by the camshaft. The rocker arms normally can slide (i.e., are axially moveable) on the rocker arm shaft. Stoppers are mounted on the rocker arm shaft to stop the axial movement of the rocker arms in one direction. Typically, coil springs also are mounted on the rocker arm shaft opposite to the stoppers, respectively, to urge the rocker arms toward the stoppers.

In some arrangements, the spring constant of each spring can be set at a relatively large value to retain the rocker arm in a precise position even when subject to large engine vibrations and shock. However, if the spring constant is excessively large, friction increases between the rocker arm and the spring, between rocker arms disposed next to each other, and between the rocker arm and the stopper. The friction causes wear of those members and more engine power is necessary to drive the camshaft in order to actuate the rocker arms.

If, on the other hand, the spring constant is excessively small, large shocks on and vibrations in the engine tend to displace the rocker arms from their precise positions. In addition, the spring occasionally can be jolted out of the its primary position or can be damaged by the shock. The shock can be particularly large in connection with an engine employed for an outboard motor. This is because the outboard motor is typically mounted on an associated watercraft with a drive unit, which carries an engine, capable to popping up when the drive unit strikes an obstacle such as driftwood. The engine experiences large shock forces, not only when the drive unit strikes the obstacle, but also as drive unit momentarily pops up and then returns to its normal trim position.

A need therefore exists for an improved rocker arm arrangement for an engine that can retain at least one rocker arm in a precise preset position without significantly increasing friction on the rocker arm, and that can inhibit movement of the rocker arm from its preset position when the engine is subjected to a large shock force.

SUMMARY OF THE INVENTION

In accordance with one aspect of the present invention, an internal combustion engine comprises an engine body. A moveable member is moveable relative to the engine body. The engine body and the moveable member together define a combustion chamber. The engine body defines an intake passage communicating with the combustion chamber at an intake port thereof and an exhaust passage communicating with the combustion chamber at an exhaust port thereof An intake valve is arranged to move between an open position and a closed position relative to the intake port. An exhaust valve is arranged to move between an open position and a closed position relative to the exhaust port. A camshaft is journaled for rotation within the engine body. A rocker arm shaft is also disposed within the engine body. At least first and second rocker arms are pivotally mounted on the rocker arm shaft. The first rocker arm cooperates with the intake valve. The second rocker arm cooperates with the exhaust valve. The camshaft actuates the intake and exhaust valves through the first and second rocker arms, respectively. At least one of the rocker arms is (and preferably both are) axially moveable along an axis of the rocker arm shaft. A stopper, which is disposed on the rocker arm shaft, is arranged to stop the axial movement of the rocker arm in one direction. A biasing member is mounted on the rocker arm shaft opposite to the stopper to urge the rocker arm toward the stopper. A block member is arranged to limit the axial movement of the rocker arm in a direction working against the biasing member.

In accordance with another aspect of the present invention, an internal combustion engine comprises an engine body. A moveable member is moveable relative to the engine body. The engine body and the moveable member together define a combustion chamber. The engine body defines an intake passage communicating with the combustion chamber at an intake port thereof and an exhaust passage communicating with the combustion chamber at an exhaust port thereof. An intake valve is arranged to move between an open position and a closed position relative to the intake port. An exhaust valve is arranged to move between an open position and a closed position relative to the exhaust port. A camshaft is journaled for rotation within the engine body. A rocker arm shaft is also disposed within the engine body. At least one intake rocker arm and at least one exhaust rocker arm are pivotally mounted on the rocker arm shaft. The camshaft actuates the intake and exhaust valves through the intake and exhaust rocker arms, respectively. At least one of the rocker arms is axially moveable along an axis of the rocker arm shaft. A stopper is disposed on the rocker arm shaft to stop the axial movement of the rocker arms in one direction. A biasing member is mounted on the rocker arm shaft opposite to the stopper to urge at least one of the rocker arms toward the stopper and to dampen the axial movement of the rocker arm in an opposite direction to the one direction. A protector is configured to protect the biasing member against shock caused by the axial movement of the rocker arm in the opposite direction.

In accordance with a further aspect of the present invention, an internal combustion engine comprises an engine body. A moveable member is moveable relative to the engine body. The engine body and the moveable member together define a combustion chamber. The engine body defines an intake passage communicating with the combustion chamber at an intake port thereof and an exhaust passage communicating with the combustion chamber at an exhaust port thereof. An intake valve is arranged to move between an open position and a closed position relative to the intake port. An exhaust valve is arranged to move between an open position and a closed position relative to the exhaust port. A camshaft is journaled for rotation within the engine body. A rocker arm shaft is also disposed within the engine body. At least first and second rocker arms are pivotally mounted on the rocker arm shaft. The first rocker arm cooperates with the intake valve. The second rocker arm cooperates with the exhaust valve. The camshaft actuates the intake and exhaust valves through the first and second rocker arms, respectively. The rocker arms are axially moveable along an axis of the rocker arm shaft. A stopper is disposed on the rocker arm shaft to stop the axial movement of the rocker arms in one direction. A spring member is disposed opposite to the stopper with at least one of the rocker arms disposed between the spring member and the stopper. The spring member includes a mounting section at which the spring unit is mounted onto the rocker arm shaft. The spring member further includes at least one leaf spring section that extends from the mounting section in another direction to acts against one of the first and second rocker arms that is disposed next to the spring member.

In accordance with a still further aspect of the present invention, an internal combustion engine comprises an engine body. A moveable member is moveable relative to the engine body. The engine body and the moveable member together define a combustion chamber. The engine body defines a passage communicating with the combustion chamber at a port thereof. A valve is arranged to move between an open position and a closed position relative to the port. A camshaft is journaled for rotation within the engine body. A rocker arm shaft is also disposed within the engine body. A rocker arm is pivotally mounted on the rocker arm shaft. The camshaft actuates the valve through the rocker arm. The rocker arm is axially moveable along an axis of the rocker arm shaft. A stopper is disposed on the rocker arm shaft to stop the axial movement of the rocker arm in one direction. Means are provided for biasing the rocker arm toward the stopper. Further means are provided for limiting the rocker arm from moving toward the means for biasing the rocker arm beyond a preset distance.

BRIEF DESCRIPTION OF THE DRAWINGS

These and other features, aspects and advantages of the present invention will now be described with reference to the drawings of a preferred embodiment, which embodiment is intended to illustrate and not to limit the present invention. The drawings comprise seven figures.

DETAILED DESCRIPTION OF THE PREFERRED EMBODIMENT OF THE PRESENT INVENTION

Figure 1:
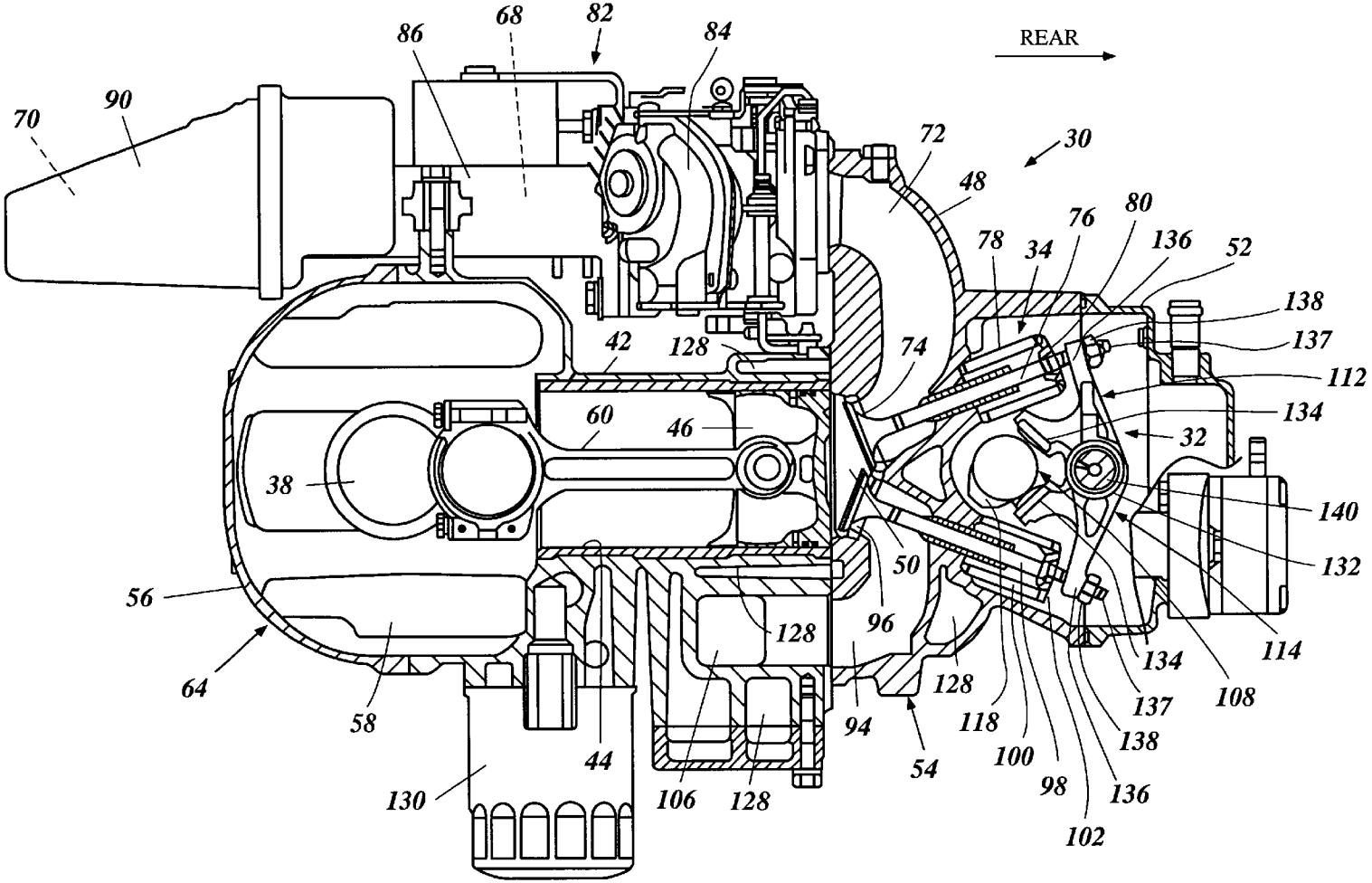
FIG. 1 is a sectional top plan view of an engine configured in accordance with certain features, aspects and advantages of a preferred embodiment of the present invention.
Figure 2:
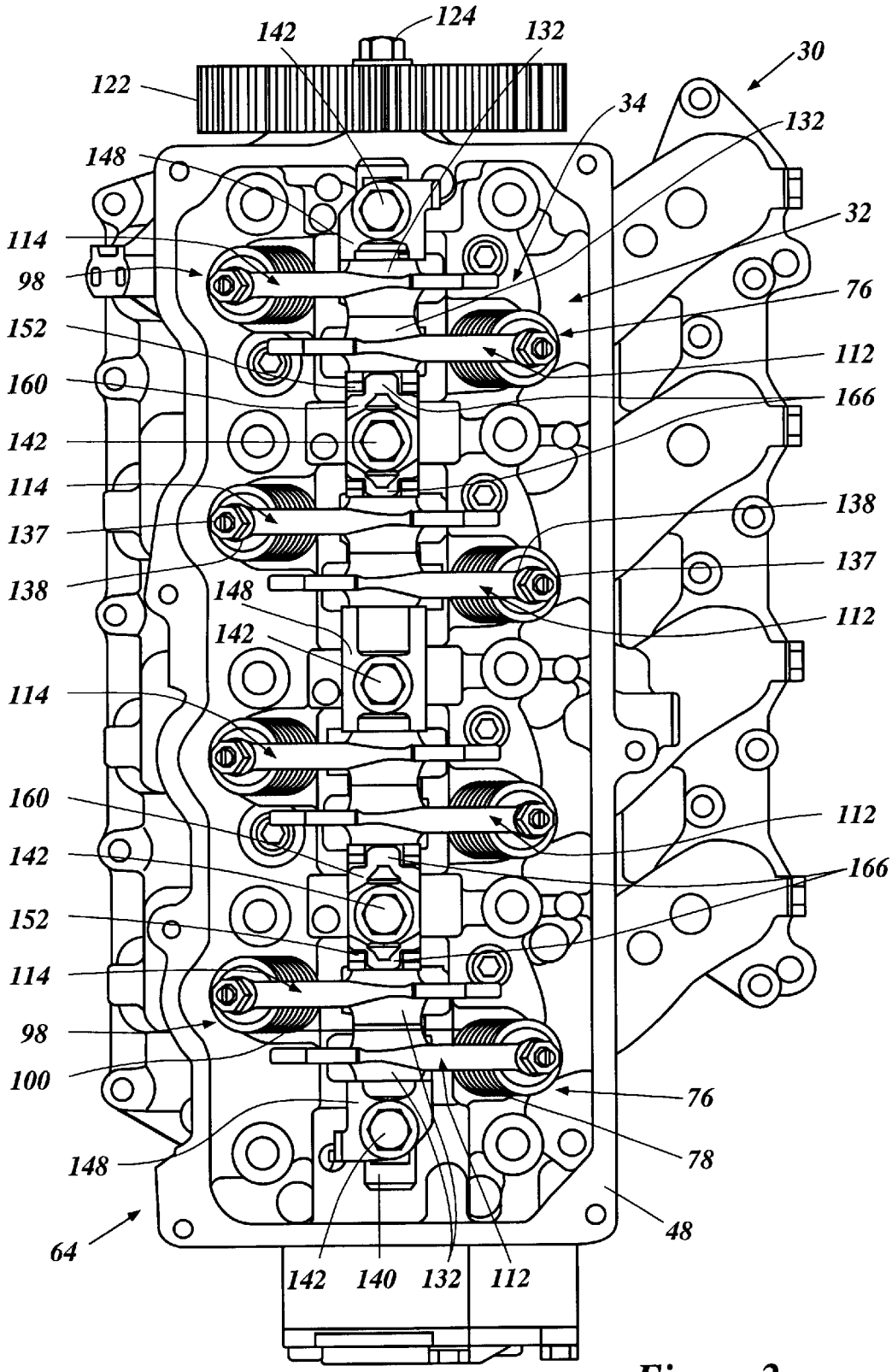
FIG. 2 is a front view of a cylinder head assembly of the engine shown in FIG. 1 to illustrate a valve drive mechanism without a cylinder head cover member.
Figure 3:
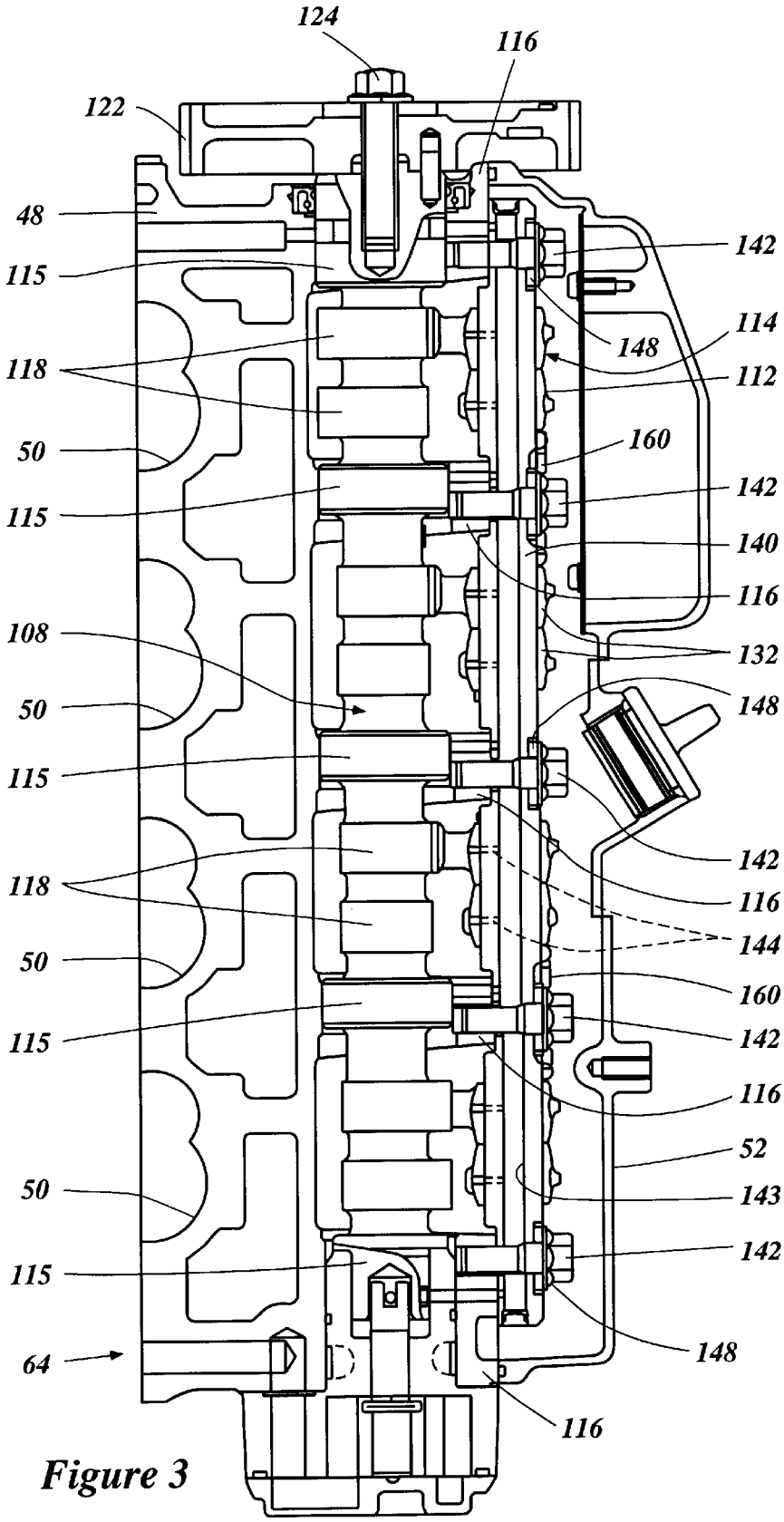
FIG. 3 is a sectional side elevational view of the cylinder head assembly of FIG. 2 to illustrate the valve drive mechanism without spring members.

With reference to FIGS. 1–3, an overall construction of an internal combustion engine 30 that features an improved rocker arm unit 32 will be described. The rocker arm unit 32 is part of a valve drive mechanism 34 and is configured in accordance with certain features, aspects and advantages of the present invention.

The exemplary engine 30 is designed for use in an outboard motor as the present rocker arm unit 32 has particular utility in the context of the outboard motor. The engine 30, however, can be used with other types of marine drives (i.e., inboard motors, inboard/outboard motors, etc.) and also certain land vehicles, which includes lawnmowers, motorcycles, go carts, all terrain vehicles, snowmobiles and the like. Furthermore, the engine 30 can be used as a stationary engine for some applications that will apparent to those of ordinary skill in the art.

In general, the outboard motor comprises a drive unit and a bracket assembly that supports the drive unit on an associated watercraft and places a marine propulsion device such as, for example, a propeller, in a submerged position with the watercraft resting relative to a surface of a body of water. Typically, the engine 30 is supported atop the drive unit. A crankshaft 38 of the engine 30 is connected to the marine propulsion device by a driveshaft and a propulsion shaft; both shafts extend through the drive unit. The engine 30 preferably is surrounded by a detachable cowling assembly that has at least one opening through which air flows into an internal cavity thereof.

As is well known, the bracket assembly includes a hydraulic or manually operable tilt and trim adjustment system for tilt movement (raising or lowering) of the drive unit relative to the watercraft. The tilt system preferably includes a pop-up mechanism that permits the drive unit can pop-up when it strikes an obstacle, such as driftwood, so as to protect the drive unit.

The engine 30 in the illustrated embodiment preferably operates on a four-cycle combustion principle. More specifically, the illustrated engine 30 is a single-overhead-cam (SOHC), four cylinder engine. A cylinder block 42 defines four cylinder bores 44 that extend generally horizontally and are vertically spaced above one another.

This type of engine, however, merely exemplifies one type of engine on which various aspects and features of the present invention can be suitably used. Engines having other numbers of cylinders, having other cylinder arrangements (V-configuration, opposing, etc.), also can employ various features, aspects and advantages of the present invention. In addition, the engine can be formed with separate cylinder bores rather than a number of cylinder bores formed in a cylinder block. Regardless of the particular construction, the engine preferably comprises an engine body that includes at least one cylinder bore.

A moveable member, such as a reciprocating piston, moves relative to the cylinder block 42 in a suitable manner. In the illustrated arrangement, a piston 46 reciprocates within each cylinder bore 44. A cylinder head member 48 is affixed to one end of the cylinder block 42. The cylinder head member 48 together with the associated pistons 46 and cylinder bores 44, preferably define four combustion chambers 50. Of course, the number of combustion chambers can vary as described above. The cylinder head member 48 is covered with a cylinder head cover member 52. The cylinder head member 48 and the cylinder head cover member 52 together define a cylinder head assembly 54.

A crankcase member 56 is coupled with the cylinder block 42 to close the other end of the cylinder bores 44 and, together with the cylinder block 42, define a crankcase chamber 58. The crankshaft 38 extends generally vertically through the crankcase chamber 58 and can be journaled for rotation about a rotational axis by several bearing blocks. Connecting rods 60 couple the crankshaft 38 with the respective pistons 46 in a suitable manner so that the reciprocal movement of the pistons 46 rotates the crankshaft 38.

Preferably, the crankcase member 56 is located at the forward-most position of the engine 30 with the cylinder block 42, the cylinder head member 48 and the cylinder head cover member 52 being disposed rearward from the crankcase member 56 one after another. In the illustrated arrangement, the cylinder block 42, the cylinder head member 48, the cylinder head cover member 52 and the crankcase member 56 together define an engine body 64.

The engine 30 also comprises an air intake system. The air intake system draws air from within the cavity of the cowling assembly and delivers the air to the combustion chambers 50. The air intake system preferably comprises four intake passages 68 and a plenum chamber 70. The most-downstream portions of the intake passages 68 are defined within the cylinder head member 48 as a set of inner intake passages 72. The inner intake passages 72 communicate with the combustion chambers 50 through intake ports 74. Typically, each combustion chamber 50 has one or more intake ports 74. In the illustrated embodiment, each combustion chamber 50 has one intake port 74.

Intake valves 76 are slideably mounted in the cylinder head member 48 to move between an open position and a closed position relative to the respective intake ports 74. Valve springs 78, which preferably are coil compression springs, urge the intake valves 76 toward the respective closed positions by acting between mounting bosses formed on the cylinder head member 48 and corresponding retainers 80 on the stems of the valves 76. When each intake valve 76 is in the open position, the inner intake passage 72 associated with the intake port 74 communicates with the associated combustion chamber 50.

Outer portions of the intake passages 68, which are disposed outside of the cylinder head member 48, preferably are defined with intake conduits 82. In the illustrated arrangement, each intake conduit 82 is formed by two pieces. One piece is a throttle body 84 in which a throttle valve (not shown) is positioned. Another piece is an intake runner 86 disposed upstream of the throttle body 84. The respective intake conduits 82 extend forwardly from the cylinder head member 48 along a side surface of the engine body 64 on the starboard side of the outboard motor. The respective intake conduits 82 lie generally parallel to each other and are vertically spaced apart from one another.

Preferably, the throttle valves are butterfly valves that have valve shafts journaled for pivotal movement. In some arrangements, the valve shafts are linked together and are connected to a control linkage. The operator can control the opening degree of the throttle valves by operating the control linkage. The throttle valves can regulate amounts of air that are supplied to the combustion chambers 50. Normally, the greater the opening degree, the higher the rate of airflow and the higher the engine speed.

The plenum chamber 70 is defined with a plenum chamber unit 90. The plenum chamber unit 90 has an inlet (not shown) through which air in the cavity is drawn into the plenum chamber 70. The plenum chamber 70 reduces pulsation of intake air and attenuates intake noise.

The engine 30 further comprises an exhaust system that routes burnt charges, i.e., exhaust gases, to a location outside of the outboard motor. The cylinder head member 48 defines a set of inner exhaust passages 94 that communicate with the combustion chambers 50 through one or more exhaust ports 96. In the illustrated embodiment, each combustion chamber has one exhaust port 96; however, two or more exhaust ports per cylinder also can be used. Like the intake valves 76, exhaust valves 98 are slideably mounted in cylinder head member 48 to move between an open position and a closed position relative to the exhaust ports 96. Valve springs 100 urge the exhaust valves 98 toward the respective closed positions by acting between mounting bosses formed on the cylinder head member 48 and corresponding retainers 102 on the stems of the valves 98. When each exhaust valve 98 is in the open position, the inner exhaust passage 94 associated with the exhaust port 96 communicates with the associated combustion chamber 50.

An exhaust manifold 106 preferably is defined within the cylinder block 42 to extend generally vertically on the port side of the outboard motor. The exhaust manifold 106 communicates with the combustion chambers 50 through the inner exhaust passages 94 and the exhaust ports 96 to collect exhaust gases therefrom. The exhaust manifold 106 is coupled with internal exhaust passages defined within the drive unit. When the exhaust ports 96 are opened, the combustion chambers 50 communicate with the internal exhaust passages. The exhaust gases from the combustion chambers 50 are discharged to a location out of the outboard motor through the exhaust manifold 106 and the internal exhaust passages of the drive unit.

The valve drive mechanism 34 is provided for driving the intake and exhaust valves 76, 98. The illustrated valve drive mechanism 34 comprises a single camshaft 108 and the rocker arm unit 32 including four intake rocker arms 112 and four exhaust rocker arms 114. The camshaft 108 extends generally vertically within the cylinder head assembly 54 between the intake and exhaust valves 76, 98. The illustrated camshaft 108 is journaled for rotation at five cam journals 115 by five bearing sections 116 formed at the cylinder head member 48 or at end members fixed to the cylinder head member 48. The camshaft 108 has cam lobes 118 to push the intake and exhaust rocker arms 112, 114 of the rocker arm unit 32 in a timed manner, which is in proportion to the engine speed. The intake and exhaust rocker arms 112, 114, in turn, actuate the intake and exhaust valves 76, 98, respectively, to bring these valves 76, 98 to either the open positions and the closed positions. The rocker arm unit 32 will be described in greater detail shortly with additional reference to FIGS. 4–6.

A camshaft drive mechanism is preferably is provided for driving the valve drive mechanism 34. The camshaft drive mechanism is generally formed atop the engine body 64. The camshaft drive mechanism comprises a driven sprocket 122 positioned atop the camshaft 108, a drive sprocket positioned atop the crankshaft 38 and a flexible transmitter, such as a timing belt or chain 140, for instance, wound around the driven sprocket 122 and the drive sprocket. The driven sprocket 122 is affixed to the camshaft 108 by a bolt 124. The crankshaft 38 thus drives the camshaft 108 through the flexible transmitter in the timed relationship.

The engine 30 preferably comprises a fuel supply system (not shown). For instance, an indirect, port or intake passage fuel injection system can be provided. In some arrangements, a direct fuel injection system is applicable. The indirect or direct fuel injection systems includes one or more fuel injectors that spray fuel to the intake passages 72 or the combustion chambers 50, respectively. Otherwise, various charge forming systems such as, for example, a carburetor system are of course applicable.

The engine 30 preferably comprises an ignition system (not shown). Each combustion chamber 50 is provided with a spark plug that preferably is disposed between the intake and exhaust valves 76, 98 and next to the camshaft 108. Each spark plug has electrodes that are exposed in the associated combustion chamber 50. The electrodes generate sparks in a timed manner to fire air/fuel charges formed within the combustion chambers 50. The air/fuel charges burn to generate power that moves the pistons 46 in a direction opposite to the combustion chambers 50.

Eventually, with the air/fuel charges intermittently burning, the pistons 46 reciprocate within the cylinder bores 44 and rotate the crankshaft 38. The burnt charges, i.e., the exhaust gases, are discharged to the location of the outboard motor through the exhaust system.

The engine 30 may comprise any other systems, mechanisms, sensors, devices, accessories and components other than those described above such as, for example, a cooling system and a lubrication mechanism. FIG. 1, for example, illustrates water jackets 128 of the cooling system and an oil filter unit 130 of the lubrication mechanism.

Exemplary outboard motors and engines are disclosed, for example, in U.S. Pat. No. 5,816,208 and United States Patent Application Publication No. US 2001/0017119A1, the disclosures of which are hereby incorporated by reference in their entirety.

Figure 4:
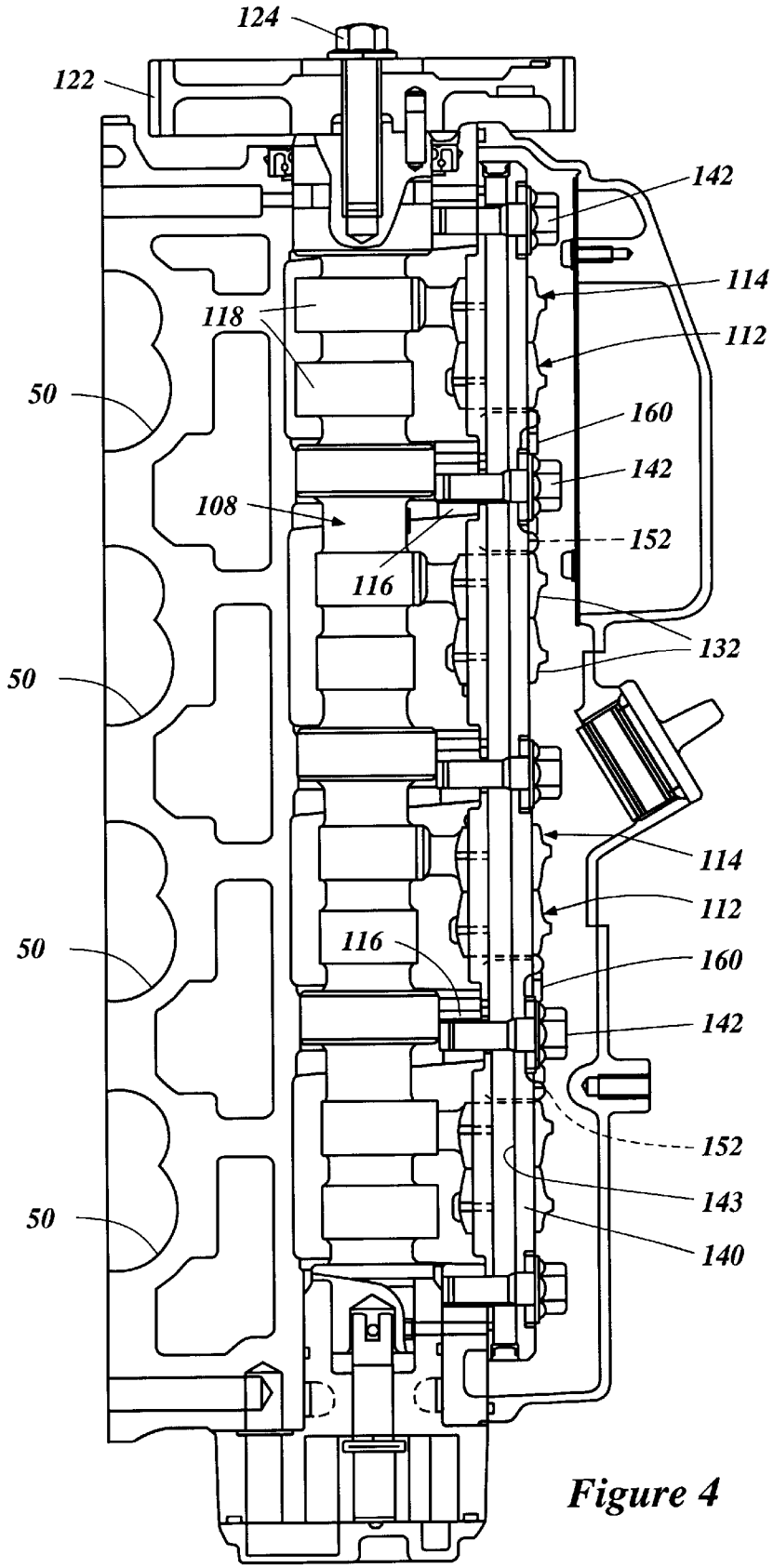
FIG. 4 is a sectional side elevational view of the cylinder head assembly of FIG. 2 to illustrate the valve drive mechanism with the spring members.

With continued reference to FIGS. 1–3 and with additional reference to FIGS. 4–6, the valve drive mechanism 34, particularly, the rocker arm unit 32 will now be described in greater detail.

The illustrated camshaft 108 actuates the intake and exhaust valves 76, 98 through the intake and exhaust rocker arms 112, 114, as described above. With particular reference to FIGS. 1–3, each rocker arm 112, 114 comprises a boss portion 132, a follower portion 134 and an actuating portion 136. Each boss portion 132 is pivotally mounted on a rocker arm shaft 140 that preferably is supported by the respective bearing sections 116 of the cylinder head member 48 by bolts 142. Each follower portion 134 extends from the boss portion 132 toward one of the cam lobes 118 to follow the profile of the associated cam lobe 118. Each actuating portion 136 extends from the boss portion 132 opposite to the follower portion 134 toward each end of the intake or exhaust valve 76, 98. The actuating portion 136 has an aperture through which a rocker adjusting screw 137 is fitted. The adjusting screw 137 is held in place by a lock nut 138. The adjusting screw 137 can contact the end of the intake or exhaust valve 76, 98 to push the valve with the follower portion 134 following the cam lobe 118. A space between the screw 137 and the end of the valve 76, 98 is adjustable because the screw 137 is moveable along a longitudinal axis of the valve 76, 98.

With particular reference to FIGS. 2 and 3, the rocker arm shaft 140 extends generally vertically and parallel to the camshaft 108. The rocker arm shaft 140 preferably defines a lubricant delivery passage 143 that is connected to each lubricant discharge passage 144 defined in each rocker arms 112, 114 to supply lubricant to a surface of the rocker arm 112, 114 for inhibiting frictional wear thereof. In the illustrated embodiment, a set of intake and exhaust valves 76, 98 are disposed between the bearing sections 116 positioned next to one another with the exhaust valve 98 placed above the intake valve 76. Accordingly, boss portions 132 of the rocker arms 112, 114 are juxtaposed with each other on the rocker arm shaft 140. The exhaust rocker arm 114 inevitably is positioned above the intake rocker arm 112 in the each set.

In the illustrated embodiment, the rocker arms 112, 114 are axially moveable along a longitudinal axis of the rocker arm shaft 140. Three stoppers 148 are disposed at the top, center and bottom bearing sections 116 to stop the axial movement of the rocker arms 112, 114 in one direction. Each stopper 148 preferably is made of sheet metal and is generally configured flat. The stoppers 148 preferably are affixed to the rocker arm shaft 140 by the bolts 142 simultaneously when the rocker arm shaft 140 is affixed to the bearing sections 116.

Two spring members 152 preferably are disposed at the reminder bearing sections 116 opposite to the stoppers 148 to urge the rocker arms 112, 114 toward the stoppers 148. With particular reference to FIG. 6, the spring members 152 preferably are leaf springs made of pieces of metal sheet and each spring member 152 comprises a mounting section 154 and four spring sections 156.

The mounting section 154 preferably is generally configured flat and has a rectangular shape to mount on the rocker arm shaft 140, however, it also could have an arcuate shape that extends about a portion of the rocker arm shaft's outer surface. The mounting section 154 defines an aperture 158, which is schematically shown in phantom, at a center portion thereof. The bolt 142 associated with this spring member 154 preferably passes through the aperture 158 to fix the mounting section 154 to the rocker arm shaft 140.

The spring sections 156 extend longitudinally from four corners of the mounting section 154 along the longitudinal axis of the rocker arm shaft 140 and each set of spring sections 156 on each side of the mounting section 154 straddles the rocker arm shaft 140. The spring sections 156 are made by, for example, sheet metal bending work. A width of the mounting section 154 between both sides that have no spring sections 156 is generally equal to an outer diameter of the rocker arm shaft 140. Each spring section 156, therefore, is cut so as to follow an outer surface of the rocker arm shaft 140. The cut inner portions of the spring sections 156 are indicated by reference numeral 160. The spring sections 156 thus act against the boss portions 132 of the rocker arms 112, 114.

Thus far described, the spring sections 156 urge the rocker arms 112, 114 towards the stoppers 148 and dampen the axial movement of the rocker arms 112, 114 toward the spring members 152 (i.e., toward the mounting section 154 of each spring member 152). Usually, the axial movement of the rocker arms 112, 114 can occur with the vibration generated by the engine operation. The spring sections 156 sufficiently undergo such movement caused by the vibration. The spring constant of the spring sections 156 preferably is set at relatively small or moderate to inhibit frictional wear from occurring on the surfaces of the rocker arms 112, 114. Occasionally, however, an excessive shock can be experienced by the spring sections 156, for example, when the drive unit of the outboard motor strikes an obstacle. If large enough, the shock potentially could damage one or more of the spring sections 156 (i.e., plastically deform the spring sections 156), and consequently such spring sections 156 would no longer lie in the desired, precise positions on the rocker arm shaft.

Figure 7:
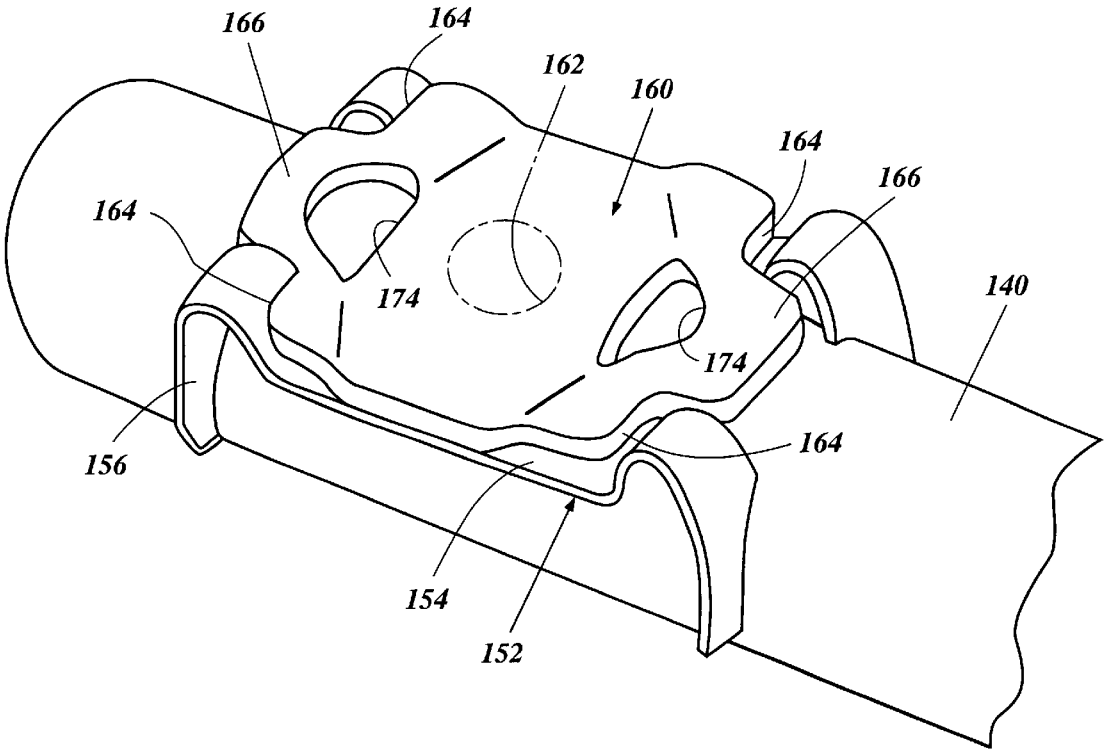
FIG. 7 is a perspective view of one of the spring members mounted on the rocker arm shaft with one of the block members.

In order to prevent the shock from damaging the spring sections 156, the rocker arm unit 32 preferably is provided with two block members or protectors 160. The block members 160 preferably are disposed on the respective spring members 152. With particular reference to FIG. 7, each block member 160 is made of sheet metal and is configured generally flat and as a rectangular shape. Each block member 160 preferably is laid on top of the mounting section 154 of the spring member 152 and defines an aperture 162, which is schematically shown in phantom, at a center portion thereof. The aperture 162 corresponds to the aperture 158 of the spring member 152. The bolt 142 associated with this block member 160 preferably can pass through the aperture 162 to fix the block member 160 to the rocker arm shaft 140 together with the mounting section 154 of the spring member 152. Four corners of each block member 160 define recessed portions 164 that face the respective spring sections 156 of the spring member 152. In other words, projections 166 are formed at both longitudinal ends of the block member 160 and the projections 166 are nested between each set of spring sections 156.

Figure 5:
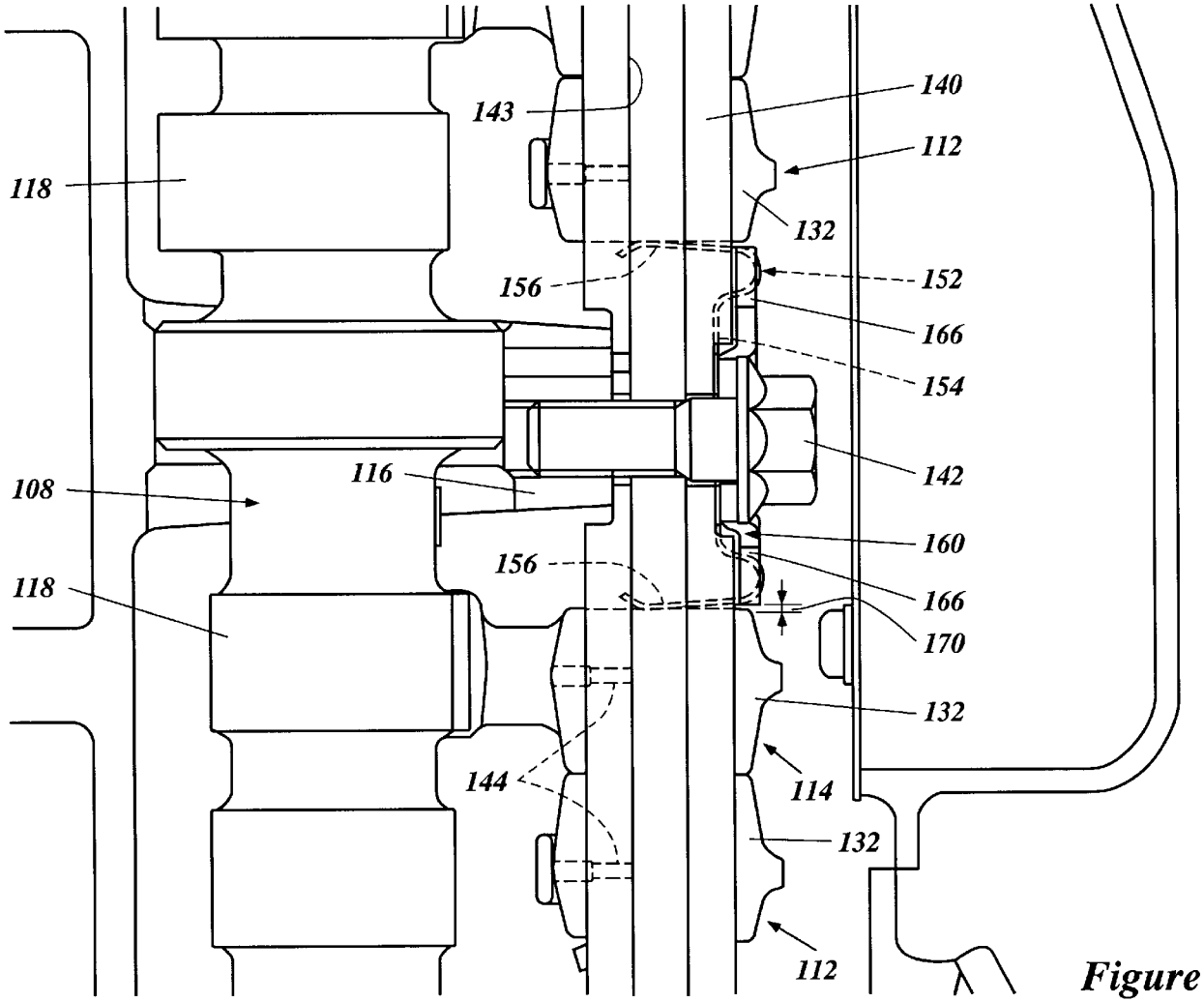
FIG. 5 is an enlarged sectional side elevational view of the cylinder head assembly of FIG. 2 to illustrate rocker arms, spring members and block members positioned on a rocker arm shaft in detail.
Figure 6:
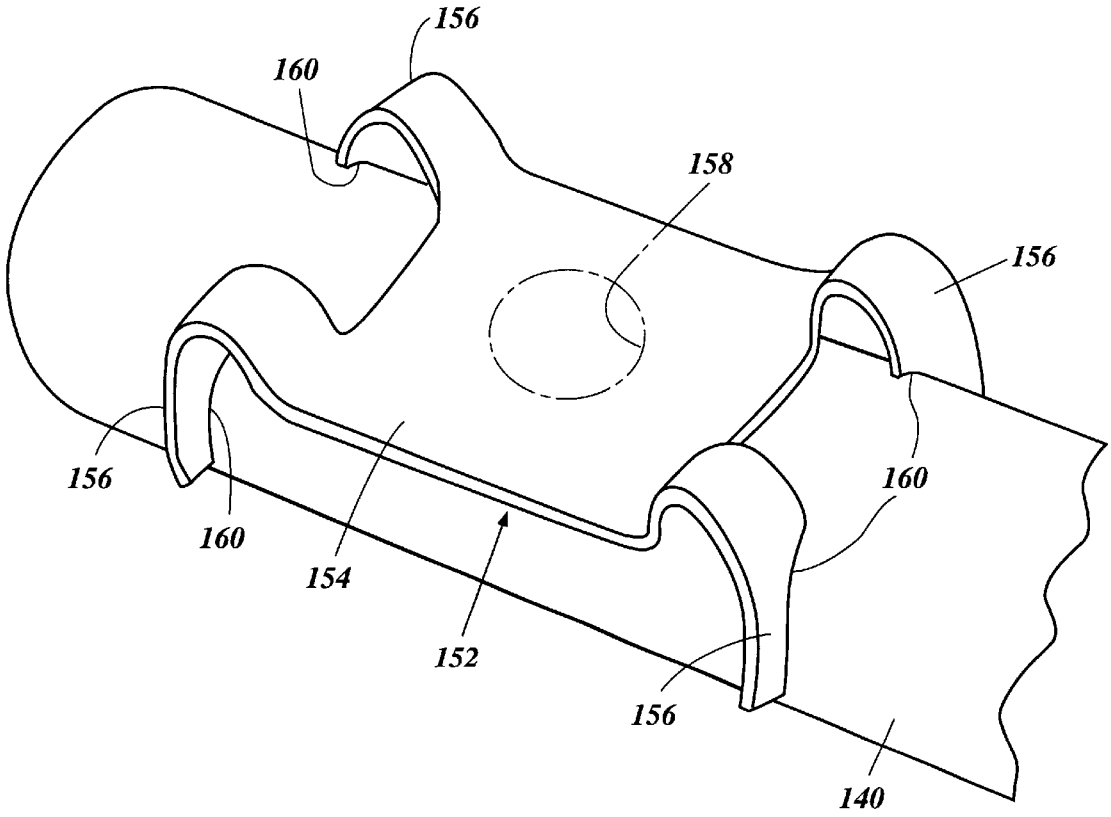
FIG. 6 is a perspective view of one of the spring members mounted on the rocker arm shaft.

With particular reference to FIG. 5, the projections 166 are opposite to the boss portions 132 of the rocker arms 112, 114. A relatively narrow space 170 is formed between each projection 166 and the boss portion 132 of the rocker arm 112, 114 facing to this projection 166. That is, normally the projections 166 do not abut on the boss portions 132.

When a shock such as that described above is experienced by the rocker arms 112, 114, the boss portions 132 thereof slide axially toward the projections 166 of the block members 160 against the spring force of the spring member 152. The projections 166 block the rocker arms 112, 114 from moving beyond the length of the space 170. Accordingly, the spring sections 156 of the spring member 152 are not excessively bent or deformed and are not damaged by the shock. In the same manner, the stoppers 148 prevent the rocker arms 112, 114 from moving in the opposite direction (i.e., away from the spring members 152).

The space 170 preferably has a length of approximately one millimeter. The length, however, can vary in accordance with, for example, a set spring constant of the spring member 152, the number of rocker arms 112, 114, the maximum magnitude of shock design for and an appropriate factor of safety, and other set conditions of the engine 30.

Each block member 160 can have several holes to reduce weight thereof. In the illustrated block members 160, two holes 174 are formed between the center aperture 162 and the respective projections 166. In addition, it is understood that the spring member 152 and the block member 160 can be unitarily formed.

Of course, the foregoing description is that of a preferred construction having certain features, aspects and advantages in accordance with the present invention. Various changes and modifications may be made to the above-described arrangements without departing from the spirit and scope of the invention, as defined by the appended claims. For instance, either the spring members or the block members or both of them can have configurations fitting along the outer surface of the rocker arm shaft rather than have flat shapes. The respective block members are not necessarily positioned closely to the respective spring members and can be spaced apart from the respective spring members. Accordingly, the scope of the present invention should not be limited to the illustrated configurations, but should only be limited to a fair construction of the claims that follow and any equivalents thereof.

What is claimed is:

1. An internal combustion engine comprising an engine body, a moveable member moveable relative to the engine body, the engine body and the moveable member together defining a combustion chamber, the engine body defining a passage communicating with the combustion chamber relative to a port thereof, a valve arranged to move between an open position and a closed position relative to the port, a camshaft journaled for rotation within the engine body, a rocker arm shaft disposed within the engine body, the camshaft actuating the valve through the rocker arm, the rocker arm axially moveable along an axis of the rocker arm shaft, a stopper disposed on the rocker arm shaft to stop the axial movement of the rocker arm in one direction, an elastic member mounted on the rocker arm shaft opposite of the stopper to urge the rocker arm toward the stopper, and a block member arranged to limit the axial movement of the rocker arm in a direction working against the elastic member, the block member being disposed on the same side as the elastic member relative to the rocker arm.

2. An internal combustion engine comprising an engine body, a moveable member moveable relative to the engine body, the engine body and the moveable member together defining a combustion chamber, the engine body defining a passage communicating with the combustion chamber relative to a port thereof, a valve arranged to move between an open position and a closed position relative to the port, a camshaft journaled for rotation within the engine body, a rocker arm shaft disposed within the engine body, the camshaft actuating the valve through the rocker arm, the rocker arm axially moveable along an axis of the rocker arm shaft, a stopper disposed on the rocker arm shaft to stop the axial movement of the rocker arm in one direction, an elastic member mounted on the rocker arm shaft opposite to the stopper to urge the rocker arm toward the stopper, and a protector configured to protect the elastic member against shock caused by the axial movement of the rocker arm in the opposite direction, the protector being disposed on the same side as the elastic member relative to the rocker arm.

3. An internal combustion engine comprising an engine body, a moveable member moveable relative to the engine body, the engine body and the moveable member together defining a combustion chamber, the engine body defining a passage communicating with the combustion chamber relative to a port thereof, a valve arranged to move between an open position and a closed position relative to the port, a camshaft journaled for rotation within the engine body, a rocker arm shaft disposed within the engine body, the camshaft actuating the valve through the rocker arm, the rocker arm axially moveable along an axis of the rocker arm shaft, a stopper disposed on the rocker arm shaft to stop the axial movement of the rocker arm in one direction, and a spring member disposed so as to oppose the stopper, the spring member having a mounting section at which the spring member is mounted onto the rocker arm shaft, and at least one leaf spring section extending from the mounting section in another direction to act against the rocker arm.

4. An internal combustion engine comprising an engine body, a moveable member moveable relative to the engine body, the engine body and the moveable member together defining a combustion chamber, the engine body defining an intake passage communicating with the combustion chamber at an intake port thereof and an exhaust passage communicating with the combustion chamber at an exhaust port thereof an intake valve arranged to move between an open position and a closed position relative to the intake port, an exhaust valve arranged to move between an open position and a closed position relative to the exhaust port, a camshaft journaled for rotation within the engine body, a rocker arm shaft disposed within the engine body, at least one of first and second rocker arms pivotally mounted on the rocker arm shaft, the first rocker arm being arranged to cooperate with the intake valve and the second rocker arm being arranged to cooperate with the exhaust valve, the rocker arm on the rocker arm shaft being axially moveable along an axis of the rocker arm shaft, a stopper disposed on the rocker arm shaft to stop the axial movement of the rocker arm in one direction, a biasing member mounted on the rocker arm shaft opposite to the stopper to urge continuously the rocker arm toward the stopper, and a block member arranged to limit the axial movement of the rocker arm in a direction working against the biasing member, the block member being disposed on the same side as the biasing member relative to the rocker arm.

5. The engine as set forth in claim 4, wherein the block member is mounted on the rocker arm shaft.

6. The engine as set forth in claim 5, wherein the block member generally has a flat shape.

7. The engine as set forth in 6, wherein the biasing member generally has a flat shape, and the block member lies between at least a portion of the biasing member and the rocker arm shaft.

8. The engine as set forth in claim 4, wherein the biasing member includes at least one leaf spring section acting against the rocker arm.

9. The engine as set forth in claim 8, wherein the biasing member additionally includes a mounting section affixed to the rocker arm shaft.

10. The engine as set forth in claim 9, wherein the mounting section generally is flat.

11. The engine as set forth in claim 8, wherein at least part of an inner section of the leaf spring section, which lies adjacent to an exterior surface of the rocker arm shaft, has an shape that generally matches the exterior surface of the rocker arm shaft.

12. The engine as set forth in claim 4, wherein the biasing member is configured to dampen the axial movement of the rocker arm in an opposite direction to the one direction.

13. The engine as set forth in claim 4, wherein the block member is normally spaced apart from the rocker arm by a preset distance.

14. The engine as set forth in claim 4, wherein the rocker arm shaft extends generally parallel to the camshaft.

15. The engine as set forth in claim 4, wherein both the camshaft and the rocker arm shaft extend generally vertically.

16. The engine as set forth in claim 4, wherein the stopper is mounted onto the rocker arm shaft.

17. The engine as set forth in claim 4, wherein both the first and second rocker arms are pivotally mounted on the rocker arm shaft and are axially moveable along an axis of the rocker arm shaft, and the biasing member is arranged to urge both rocker arms toward the stopper.

18. The engine as set forth in claim 4, wherein the biasing member has elasticity.

19. The engine as set forth in claim 18, wherein the biasing member is fully contractible, the block member is normally positioned apart from the rocker arm and abuts the rocker arm before the biasing member fully contracts when the rocker arm moves in the direction working against the biasing member.

20. An internal combustion engine comprising an engine body, a moveable member moveable relative to the engine body, the engine body and the moveable member together defining a combustion chamber, the engine body defining an intake passage communicating with the combustion chamber at an intake port thereof and an exhaust passage communicating with the combustion chamber at an exhaust port thereof, an intake valve arranged to move between an open position and a closed position relative to the intake port, an exhaust valve arranged to move between an open position and a closed position relative to the exhaust port, a camshaft journaled for rotation within the engine body, a rocker arm shaft disposed within the engine body, at least one intake rocker arm or at least one exhaust rocker arm pivotally mounted on the rocker arm shaft, the rocker arm on the rocker arm shaft being axially moveable along an axis of the rocker arm shaft, a stopper disposed on the rocker arm shaft to stop the axial movement of the rocker arm in one direction, a biasing member mounted on the rocker arm shaft opposite to the stopper to urge continuously the rocker arm toward the stopper and to dampen the axial movement of the rocker arm in an opposite direction to the one direction, and a protector configured to protect the biasing member against shock caused by the axial movement of the rocker arm in the opposite direction, the protector being disposed on the same side as the biasing member relative to the rocker arm.

21. The engine as set forth in claim 20, wherein the protector is configured to limit the axial movement of the rocker arm in a direction working against the biasing member.

22. The engine as set forth in claim 20, wherein the protector includes a projection extending toward the rocker arm, the projection limiting the axial movement of the rocker arm.

23. The engine as set forth in claim 20, wherein the biasing member includes a leaf spring portion acting against the rocker arm.

24. The engine as set forth in claim 20, wherein the biasing member has elasticity.

25. An internal combustion engine comprising an engine body, a moveable member moveable relative to the engine body, the engine body and the moveable member together defining a combustion chamber, the engine body defining an intake passage communicating with the combustion chamber at an intake port thereof and an exhaust passage communicating with the combustion chamber at an exhaust port thereof, an intake valve arranged to move between an open position and a closed position relative to the intake port, an exhaust valve arranged to move between an open position and a closed position relative to the exhaust port, a camshaft journaled for rotation within the engine body, a rocker arm shaft disposed within the engine body, at least one of first and second rocker arms pivotally mounted on the rocker arm shaft, the first rocker arm arranged to cooperate with the intake valve, the second rocker arm arranged to cooperate with the exhaust valve, the rocker arm on the rocker arm shaft being axially moveable along an axis of the rocker arm shaft, a stopper mounted on the rocker arm shaft to stop the axial movement of the rocker arm in one direction, and a spring member disposed opposite to the stopper, the spring member including a mounting section at which the spring member is mounted onto the rocker arm shaft, and at least one leaf spring section extending from the mounting section in another direction to act against the rocker arms arm.

26. The engine as set forth in claim 25 additionally comprising a block member normally spaced apart from the rocker arm by a preset distance, the block member blocking the rocker arm from moving toward the spring member beyond the preset distance.

27. The engine as set forth in claim 26, wherein the block member defines a projection juxaposed with the leaf spring section.

28. The engine as set forth in claim 26, wherein the block member is mounted on the rocker arm shaft.

29. The engine as set forth in claim 26, wherein the spring member and the block member are together affixed to the rocker arm shaft.

30. The engine as set forth in claim 26, wherein the block member is disposed on the same side as the spring member relative to the rocker arm.

31. The engine as set forth in claim 25, wherein the spring member is mounted on the rocker arm shaft.

32. An internal combustion engine comprising an engine body, a moveable member moveable relative to the engine body, the engine body and the moveable member together defining a combustion chamber, the engine body defining an intake passage communicating with the combustion chamber at an intake port thereof and an exhaust passage communicating with the combustion chamber at an exhaust port thereof, an intake valve arranged to move between an open position and a closed position relative to the intake port, an exhaust valve arranged to move between an open position and a closed position relative to the exhaust port, a camshaft journaled for rotation within the engine body, a rocker arm shaft disposed within the engine body, at least one of first and second rocker arms pivotally mounted on the rocker arm shaft, the first rocker arm being arranged to cooperate with the intake valve and the second rocker arm being arranged to cooperate with the exhaust valve, the rocker arm on the rocker arm shaft being axially moveable along an axis of the rocker arm shaft, a stopper disposed on the rocker arm shaft to stop the axial movement of the rocker arm in one direction, a biasing member mounted on the rocker arm shaft opposite to the stopper to urge the rocker arm toward the stopper, and a block member arranged to limit the axial movement of the rocker arm in a direction working against the biasing member, the block member being mounted on the rocker arm shaft, the biasing member and the block member together being affixed to the rocker arm shaft with a common fastener.

33. An internal combustion engine comprising an engine body, a moveable member moveable relative to the engine body, the engine body and the moveable member together defining a combustion chamber, the engine body defining an intake passage communicating with the combustion chamber at an intake port thereof and an exhaust passage communicating with the combustion chamber at an exhaust port thereof, an intake valve arranged to move between an open position and a closed position relative to the intake port, an exhaust valve arranged to move between an open position and a closed position relative to the exhaust port, a camshaft journaled for rotation within the engine body, a rocker arm shaft disposed within the engine body, at least one of first and second rocker arms pivotally mounted on the rocker arm shaft, the first rocker arm being arranged to cooperate with the intake valve and the second rocker arm being arranged to cooperate with the exhaust valve, the rocker arm on the rocker arm shaft being axially moveable along an axis of the rocker arm shaft, a stopper disposed on the rocker arm shaft to stop the axial movement of the rocker arm in one direction, a biasing member mounted on the rocker arm shaft opposite to the stopper to urge the rocker arm toward the stopper, the biasing member including at least two leaf spring sections straddling the rocker arm shaft, and a block member arranged to limit the axial movement of the rocker arm in a direction working against the biasing member, the block member including a projection extending toward the rocker arm, and the projection generally being positioned between the leaf spring sections.

34. An internal combustion engine comprising an engine body, a moveable member moveable relative to the engine body, the engine body and the moveable member together defining a combustion chamber, the engine body defining an intake passage communicating with the combustion chamber at an intake port thereof and an exhaust passage communicating with the combustion chamber at an exhaust port thereof, an intake valve arranged to move between an open position and a closed position relative to the intake port, an exhaust valve arranged to move between an open position and a closed position relative to the exhaust port, a camshaft journaled for rotation within the engine body, a rocker arm shaft disposed within the engine body, at least one intake rocker arm or at least one exhaust rocker arm pivotally mounted on the rocker arm shaft, the rocker arm on the rocker arm shaft being axially moveable along an axis of the rocker arm shaft, a stopper disposed on the rocker arm shaft to stop the axial movement of the rocker arm in one direction, a biasing member mounted on the rocker arm shaft opposite to the stopper to urge the rocker arm toward the stopper and to dampen the axial movement of the rocker arm in an opposite direction to the one direction, and a protector configured to protect the biasing member against shock caused by the axial movement of the rocker arm in the opposite direction, the protector limiting the axial movement of the rocker arm in a direction working against the biasing member, the protector including a projection extending toward the rocker arm the projection abutting onto the rocker arm when a shock forces the rocker arm against the biasing member.

35. The engine as set forth in claim 34, wherein the biasing member includes a leaf spring section acting against the rocker arm.

36. An internal combustion engine comprising an engine body, a moveable member moveable relative to the engine body, the engine body and the moveable member together defining a combustion chamber, the engine body defining an intake passage communicating with the combustion chamber at an intake port thereof and an exhaust passage communicating with the combustion chamber at an exhaust port thereof, an intake valve arranged to move between an open position and a closed position relative to the intake port, an exhaust valve arranged to move between an open position and a closed position relative to the exhaust port, a camshaft journaled for rotation within the engine body, a rocker arm shaft disposed within the engine body, at least first or second rocker arm pivotally mounted on the rocker arm shaft, the first rocker arm arranged to cooperate with the intake valve, the second rocker arm arranged to cooperate with the exhaust valve, the rocker arm on the rocker arm shaft axially moveable along an axis of the rocker arm shaft, a stopper mounted on the rocker arm shaft to stop the axial movement of the rocker arm in one direction, a spring member disposed opposite to the stopper, the spring member including a mounting section at which the spring unit is mounted onto the rocker arm shaft, and at least one leaf spring section extending from the mounting section in another direction to act against the rocker arm, and a block member normally spaced apart from the rocker arm by a preset distance, the block member blocking the rocker arm from moving toward the spring member beyond the preset distance, the block member defining a projection juxtaposed with the leaf spring section, and the projection being spaced apart from the rocker arm.

37. An internal combustion engine comprising an engine body, a moveable member moveable relative to the engine body, the engine body and the moveable member together defining a combustion chamber, the engine body defining an intake passage communicating with the combustion chamber at an intake port thereof and an exhaust passage communicating with the combustion chamber at an exhaust port thereof, an intake valve arranged to move between an open position and a closed position relative to the intake port, an exhaust valve arranged to move between an open position and a closed position relative to the exhaust port, a camshaft journaled for rotation within the engine body, a rocker arm shaft disposed within the engine body, at least first or second rocker arm pivotally mounted on the rocker arm shaft, the first rocker arm arranged to cooperate with the intake valve, the second rocker arm arranged to cooperate with the exhaust valve, the rocker arm on the rocker arm shaft axially moveable along an axis of the rocker arm shaft, a stopper mounted on the rocker arm shaft to stop the axial movement of the rocker arm in one direction, a spring member disposed opposite to the stopper, the spring member including a mounting section at which the spring unit is mounted onto the rocker arm shaft, and at least one leaf spring section extending from the mounting section in another direction to act against the rocker arm, and a block member normally spaced apart from the rocker arm by a preset distance, the block member blocking the rocker arm from moving toward the spring member beyond the preset distance, the spring member including at least two leaf spring sections, and the block member defining a projection nested between the leaf spring sections.

38. An internal combustion engine comprising an engine body, a moveable member moveable relative to the engine body, the engine body and the moveable member together defining a combustion chamber, the engine body defining a passage communicating with the combustion chamber relative to a port thereof, a valve arranged to move between an open position and a closed position relative to the port, a camshaft journaled for rotation within the engine body, a rocker arm shaft disposed within the engine body, a rocker arm pivotally mounted on the rocker arm shaft, the camshaft actuating the valve through the rocker arm, the rocker arm axially moveable along an axis of the rocker arm shaft, a stopper disposed on the rocker arm shaft to stop the axial movement of the rocker arm in one direction, means for continuously biasing the rocker arm toward the stopper, and means for limiting the rocker arm from moving by more than a preset distance toward the means for biasing the rocker arm, the means for limiting the rocker arm being disposed on the same side as the means for continuously biasing the rocker arm relative to the rocker arm.

* * * * *

UNITED STATES PATENT AND TRADEMARK OFFICE

CERTIFICATE OF CORRECTION

PATENT NO. : 6,748,913 B2
DATED : June 15, 2004
INVENTOR(S) : Nakayama

It is certified that error appears in the above-identified patent and that said Letters Patent is hereby corrected as shown below:

Column 11,
Line 3, after "thereof," insert -- , --.

Column 12,
Line 65, after "rocker," delete "arms".

Column 13,
Line 5, delete "juxaposed" and insert -- juxtaposed --.

Column 14,
Line 34, after "arm," insert -- , --.

Signed and Sealed this

Fourth Day of April, 2006

JON W. DUDAS
*Director of the United States Patent and Trademark Office*